United States Patent [19]

Chaborski

[11] 4,303,983

[45] Dec. 1, 1981

[54] METHOD AND APPARATUS FOR MEASURING TIME

[75] Inventor: Hoiko Chaborski, Munich, Fed. Rep. of Germany

[73] Assignee: MITEC-Moderne Industrietechnik GmbH, Ottobrunn, Fed. Rep. of Germany

[21] Appl. No.: 78,250

[22] Filed: Sep. 24, 1979

[30] Foreign Application Priority Data

Sep. 29, 1978 [DE] Fed. Rep. of Germany ..... 2842450

[51] Int. Cl.[3] ..... G04F 7/06

[52] U.S. Cl. ..... 364/569; 235/92 T; 364/571

[58] Field of Search ..... 364/569, 571; 235/92 T, 235/92 TF

[56] References Cited

U.S. PATENT DOCUMENTS

| | | | |
|---|---|---|---|
| 3,970,828 | 7/1976 | Klein | 235/92 TF |
| 4,142,680 | 3/1979 | Oswald et al. | 235/92 T |
| 4,168,525 | 9/1979 | Russell | 364/569 |
| 4,186,298 | 1/1980 | Kinbara | 235/92 T |
| 4,192,130 | 3/1980 | Takeuchi | 364/569 |

OTHER PUBLICATIONS

Begley et al., "Precision Timing Systems: Part I, Standard Scales", Instruments and Control Systems-Sep. 1970, pp. 87-89.

*Primary Examiner*—Errol A. Krass
*Attorney, Agent, or Firm*—W. G. Fasse; D. F. Gould

[57] ABSTRACT

A time duration is measured precisely and with high resolution by making three time measurements as shown in FIG. 5. The time difference $t_A$ between the leading edge of a start signal and the next following leading edge of a constant frequency time base signal is measured. The number "n" of the following leading edges is then counted including the leading edge of the time base signal following a stop signal. The number n is multiplied by the period $T_Q$ of the time signal. The time difference $t_E$ between the leading edge of the stop signal and the next following leading edge of the time base signal is measured. The real time difference $\Delta t$ is then calculated as follows $\Delta t = t_A + n \cdot T_Q - t_E$. A three part real time measurement is performed to correct the calculated result for drift and aging. Calibration measurements are made and the respective calibration factors are used in calculating the final results. The respective circuit arrangement includes a start channel, a stop channel, and the corresponding supporting circuits.

17 Claims, 5 Drawing Figures

Figure 1:
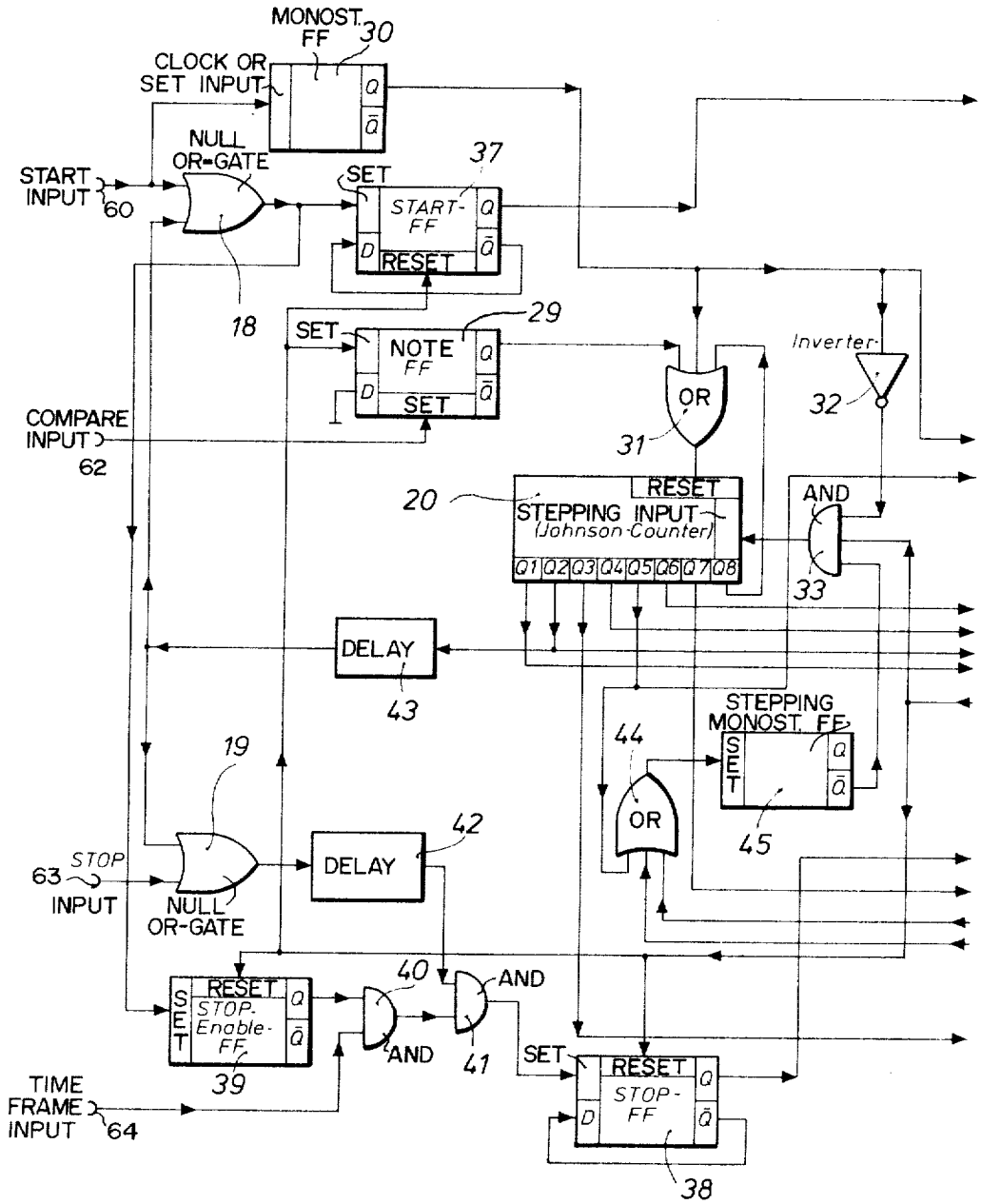
Figure 2:
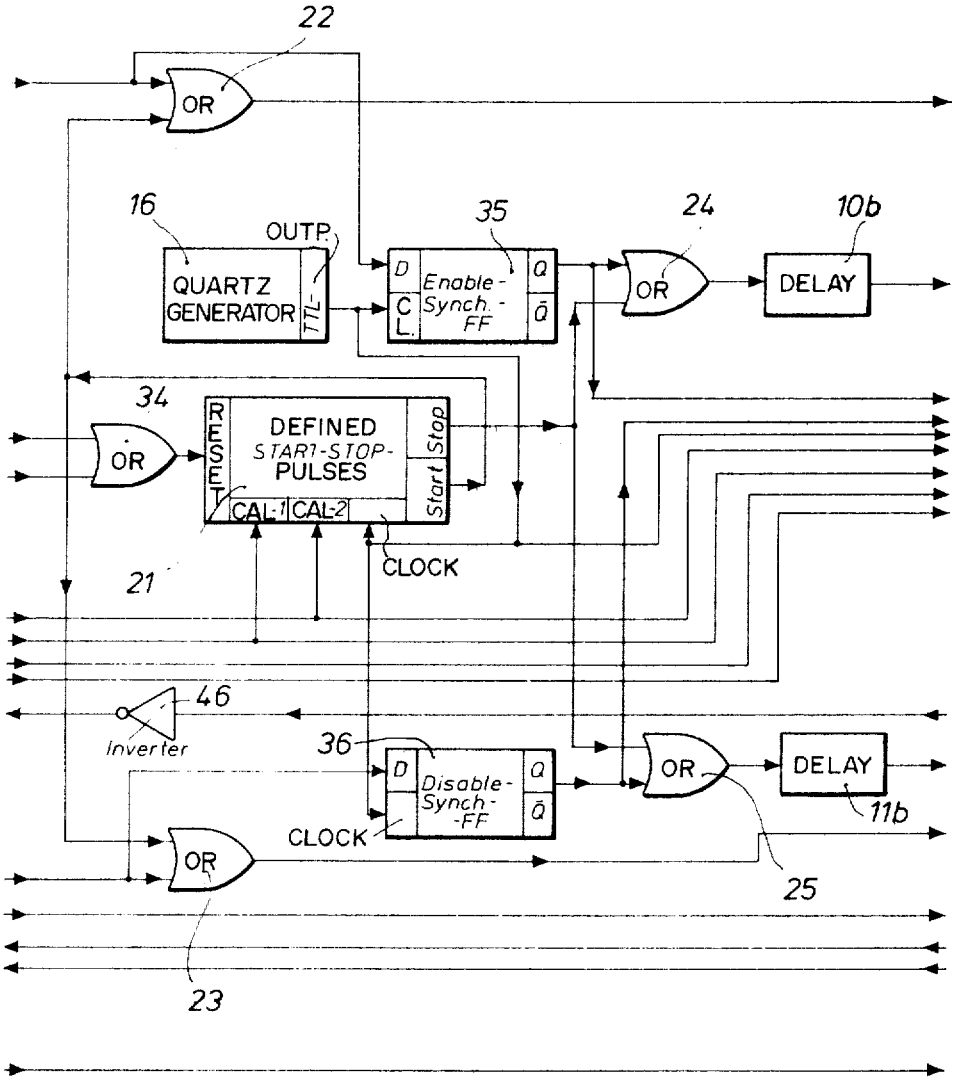
Figure 3:
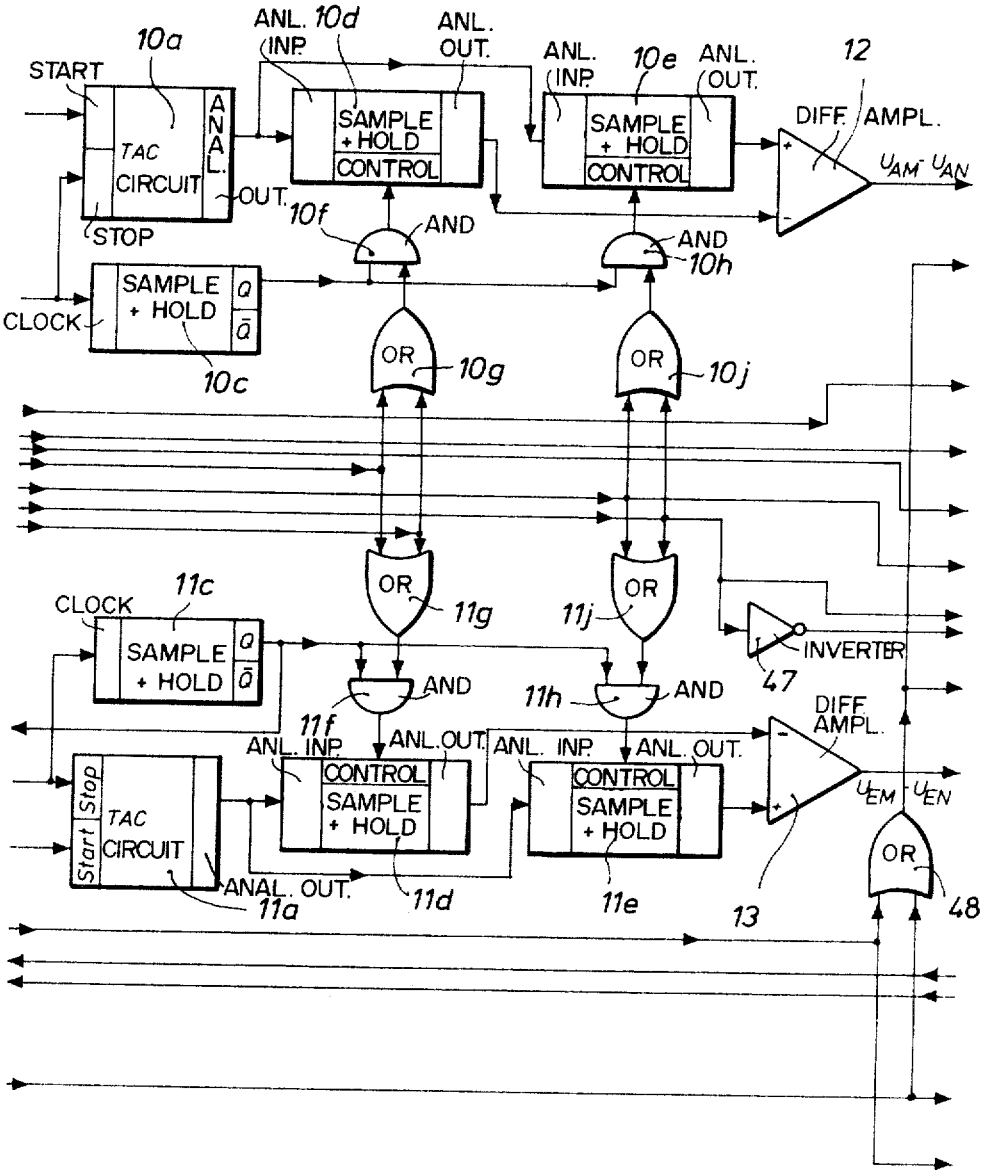
Figure 4:
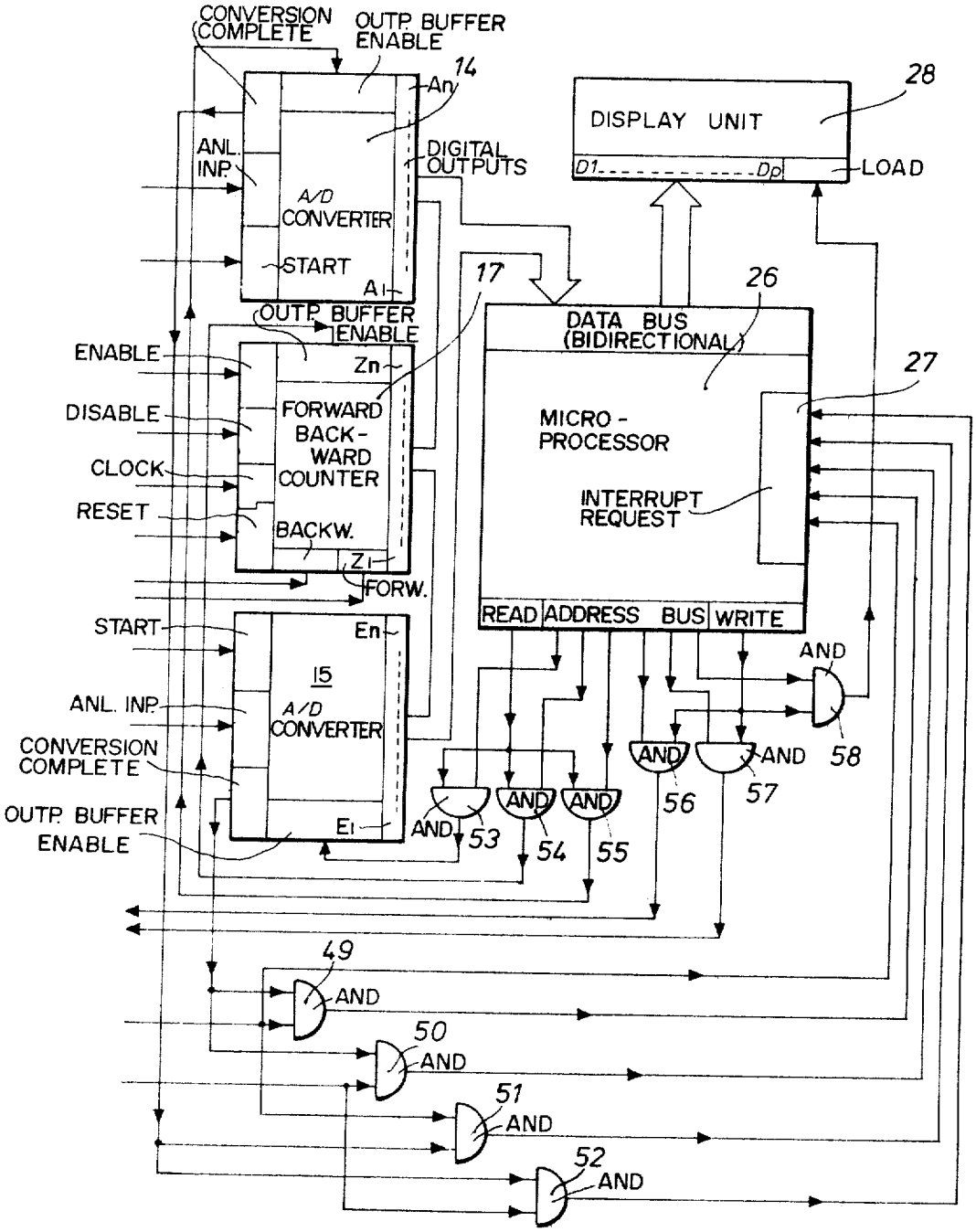

$$\Delta t = t_A + n \cdot T_Q - t_E$$

$$\Delta t = t_A + n \cdot T_Q - t_E$$

METHOD AND APPARATUS FOR MEASURING TIME

BACKGROUND OF THE INVENTION

The present invention relates to a method and an apparatus for measuring time. More specifically, the invention relates to precisely measuring time with a high resolution and to an electronic circuit arrangement for making such high precision time measurements with a high resolution. Preferably, precise quartz oscillators producing square wave output signals are used in the present method and apparatus.

Time measurements have a high resolution could be made heretofore by methods and means of the prior art only with the so-called "time-to-amplitude-conversion principle". Where a lesser resolution is satisfactory, it was customary heretofore to use counters which are started by the start signal and stopped by the stop signal. However, to accomplish a time resolution down to about five to ten nano-seconds required a substantial investment in circuit components in order to provide a counting frequency high enough for obtaining the above mentioned time resolution in the order of five to ten nano-seconds.

OBJECTS OF THE INVENTION

In view of the above it is the aim of the invention to achieve the following objects singly or in combination:

- to avoid the disadvantages of the prior art, more specifically, to combine the so-called start-stop counter system with the "time-to-amplitude-conversion principle" in a two channel time measuring circuit arrrangement, thereby to improve the time resolution;
- to provide a time measuring method and circuit arrangement capable of a time resolution in the order of twenty to fifty pico-seconds;
- to provide a time measuring method and apparatus capable of the just mentioned high resolution, meanwhile simultaneously permitting the measuring of substantially any desired length of time defined by start-stop pulses defining time differences, whereby an absolute quartz oscillator providing a square wave output signal supplies the respectively precise time base;
- to provide a time measuring circuit arrangement which is capable of an automatic self calibration and self correction in order to compensate for the different aging and different temperature characteristics of the circuit components of such circuit arrangement; and
- to produce a difference count by means of a forward-backward counter.

SUMMARY OF THE INVENTION

According to the invention three real time measurements are made in response to external start-stop signals. The real time measurements are repeated in response to internally generated start-stop signals which are generated simultaneously to eliminate different aging and temperature influences on the circuit components. The first real time measurement ascertains the time spacing between the leading edge of an external start impulse and the next following leading edge of a square wave signal generated by a high precision free-running oscillator such as a quartz oscillator. The second real time measurement involves the counting preferably of the leading edges of the square wave impulses of the square wave oscillator including the leading edge following a stop impulse. The third time measurement involves the time between the leading edge of the stop impulse and the next following leading edge of the square wave generator time base signal. The start and stop signals are, for example, generated in transistor-transistor logic circuit arrangements.

BRIEF FIGURE DESCRIPTION

Figure 5:
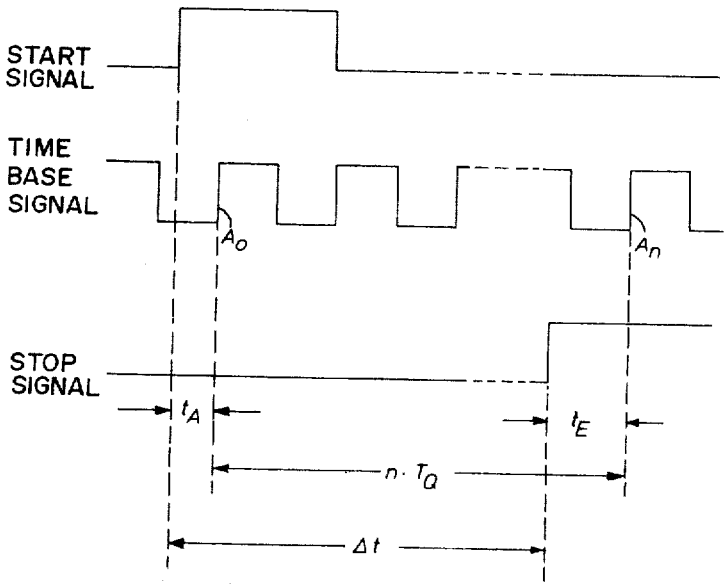

In order that the invention may be clearly understood, it will now be described, by way of example, with reference to the accompanying drawings, wherein:

FIGS. 1 to 4 illustrate a block circuit diagram of a time measuring circuit arrangement according to the invention including a start channel and a stop channel of substantially identical construction; and FIG. 5 is a pulse diagram illustrating the measuring principle on which the present invention is based.

DETAILED DESCRIPTION OF A PREFERRED EXAMPLE EMBODIMENT AND OF THE BEST MODE OF THE INVENTION

The abbreviations in the following list are used in the present specification and to some extent in the drawings to facilitate the understanding of the present description.

List of Symbols:

$t_A$ = time between the leading edge of a start pulse signal and the next following leading edge $A_o$ of a constant frequency, square wave time base signal;

$t_{AD} = t_A$ digitized;

$t_E$ = time between the leading edge of a stop pulse signal and the next following leading edge $A_n$ of said constant frequency, square wave time base signal;

$t_{ED} = t_E$ digitized;

n = number of leading edges of said time base signal counted following said start signal and including one leading edge following said stop signal;

$T_Q$ = period of said constant frequency time base signal;

$n \cdot T_Q$ = time difference between leading edges counted;

$A_o$ = first leading edge of time base signal following start pulse signal;

$A_n$ = first leading edge of time base signal following stop pulse signal;

A = designation generally referring to the start channel;

E = designation generally referring to the stop channel;

D = designation generally referring to "digitized";

$\Delta t = t_A + n \cdot T_Q - t_E$;

TAC = time amplitude converter in start channel A;

TAC = time amplitude converter in stop channel E;

$S_A$ = correction or calibration factor for changes in the characteristic of the start channel A;

$S_E$ = correction or calibration factor for changes in the characteristic of the stop channel E;

$S_Q$ = rated correction or calibration value in digital form based on $T_Q$;

$Q_1$ to $Q_8$ = time slots in an operational sequence;

M = index or designation referring to real time measurements e.g. $t_{AM}$;

N = index or designation referring to calibration or correction time measurements e.g. $t_{AN}$;

$U_M$ = analog voltage at output of time amplitude converter TAC;

$U_M = U_v - a \cdot t_{AM}$; wherein $U_v$ = supply voltage of TAC; a = conversion factor of TAC; or $U_M = U_V = e \cdot t_{EM}$; wherein e = conversion factor of TAC;

A/D = analog to digital converter;

Δ = designates time difference; and

CAL = designation or index referring to calibration.

The oscillator 16 which provides a time base signal of a constant frequency may, for example, be a quartz generator generating a frequency of 20 MHz. The time base signal is delivered in square wave form through a transistor-transistor logic output circuit arrangement well known in the art. With a time base signal of 20 MHz the time differences $t_A$ and $t_E$ may amount to maximally 50 nano-seconds (ns). Thus, a time resolution of 25 pico-seconds (ps) would require in the mentioned example a dynamic response characteristic of 1:2000 for the time measuring circuits for ascertaining the time differences $t_A$ and $t_E$. Referring first to FIG. 5, the measurement of the time difference $n \cdot T_Q$ which may represent a time difference of substantially any duration, may now be performed merely by a so-called rough measurement by using the period of the frequency of the free-running quartz oscillator as a highly precise time base and by counting by means of a counter the number n of the leading edges of the time base signal starting with the leading edge $A_o$ following the starting signal and including the leading edge $A_n$ following the stop signal. The starting signal and the stop signal are externally available or generated signals and the invention is not concerned with providing these signals.

Once the time differences $t_A$ and $t_E$ are measured and stored, it is merely necessary to calculate the expression $\Delta t = t_A + n \cdot T_Q - T_E$ by addition and subtraction in order to form a fairly precise first measured value Δt for the desired time difference between the leading edge of the starting pulse signal and the leading edge of the stop pulse signal. The starting and stopping pulse signals also have a substantially square pulse configuration.

The just described measuring of the time differences $t_A$ and $t_E$ is performed according to the invention by means of a measuring circuit arrangement having a start channel I and a stop channel II as shown in FIGS. 1 to 4. The time difference $t_A$ is ascertained in the start channel by means of a time amplitude conversion circuit arrangement TAC 10*a*. The time difference $t_E$ is ascertained in the stop channel 2 by means of a second TAC circuit 11*a* which is substantially identical to the circuit 10*a*. However, even if the two TAC's are completely identical in structure, it is possible that these circuits are subject to different aging and drifting characteristics which influence the respective individual transit times of these circuits. Therefore, it is desirable that the first measured value Δt is corrected by a so-called zero deviation value which represents such differences between the start and stop channel. The zero deviation value is taken into account by repeating the measuring operation in the start and stop channel in response to an internally produced start signal and in response to an internally produced stop signal, whereby a sequence control circuit 20 produces these internal start and stop signals substantially simultaneously and supplies these internal start and stop signals through the so-called Null-OR gates 18 and 19 to the start channel and to the stop channel respectively.

The time amplitude converter circuits 10*a* and 11*a* convert the time to be measured into an analog voltage. However, due to said different aging and different temperature response characteristics of the structural components forming these TAC circuits, the conversion factors are also varying. Therefore, the above described measuring cycle should be followed by a calibration cycle. During such calibration cycle the TAC circuits 10*a* and 11*a* receive a calibration start signal and a calibration stop signal from a circuit arrangement 21 which produces these calibration start and stop signals with a precisely defined spacing therebetween in response to the time base signal generated by the quartz generator 16. The values resulting from the calibration measurements are digitized and processed in a computer such as a micro-processor 26. These values constitute rated values. The previously measured actual values are compared with the rated values. The rated values correspond in their duration to the period $T_Q$ of the time base signal. The actual, measured values are compared to the rated value to form the respective digital correction factor $S_A$, $S_E$. These correction factors are used as conversion factors in the TAC circuits 10*a* and 11*a*. Thus, the measured values which resulted from the just preceeding measuring cycle or the measured values in the next following measuring cycle are corrected when the time differences $t_{AD}$ or $t_{ED}$ are ascertained.

A high precision, reliable time measuring circuit arrangement must take into account the above mentioned different aging and different temperature characteristics and this is being done in the circuit arrangement according to the invention in the manner described above in a self calibrating and self correcting, automatic manner.

Accordingly, the leading edge of the externally supplied start signal starts not only the actual, above described three component real time measurement, it also starts the sequence control circuit 20 which defines eight time slots $Q_1$ to $Q_8$ during which a complete measuring cycle and a complete calibration cycle take place automatically as will be described in more detail below. The leading edge of a start signal applied to the start input 60 starts the operation of the start channel which comprises the following components. The input terminal 60 forms one input of a first OR-gate 18 of the start channel. This OR-gate 18 is also referred to as the so-called "Null-OR-gate". The output of the OR-gate 18 is connected to the clock or set input of a start flip-flop circuit 37. One output of the flip-flop 37 is connected to one input of a further OR-gate 22 in the start channel. The same output of the flip-flop 37 is also connected to a D-input of a counter enable synchronizing flip-flop circuit 35. The output of the flip-flop 35 is connected to one input of a third OR-gate 24 in the start channel which is referred to as the stop OR-gate in the start channel. The output of the stop OR-gate 24 is connected through a delay circuit 10*b* to the stop input of the TAC circuit 10*a*. The start input of this TAC circuit 10*a* is connected to the output of the second OR-gate 22. The output of the delay circuit 10*b* is further connected to the trigger input of a monostable sample and hold circuit 10*c* which in turn is connected with its output to logic control circuits to be described below. The output of the TAC circuit 10*a* is connected to two sample and hold circuits 10*d* and 10*e* which in turn are connected with their respective outputs to the positive and negative input of a differential amplifier 12 the output of which is connected to the analog input of an analog-to-digital converter circuit 14.

The first three component real time measurement is designated by the index letter M. In order to measure the first real time component $t_{AM}$ defining the time between the leading edge of the starting pulse signal and the next following leading edge $A_o$ of the time base signal the start flip-flop 37 in the start channel and the stop enable flip-flop 39 in the stop channel are set through the so-called Null-OR-gate 18. By using a start flip-flop 37 it is possible to use square wave or square pulse signals of substantially any desired pulse width. The stop enable flip-flop 39 makes sure through the AND-gates 40 and 41 that a stop signal may become effective only if it is preceded by a start signal.

The flip flop 37 starts the TAC circuit 10*a* through the start OR-gate 22. Further, the OR-gate 22 prepares the data input D of the counter enable synchronizing flip-flop 35 in such a manner that the next leading edge $A_o$ of the time base signal provided by the free-running quartz oscillator 16 sets the flip-flop 35 whereby the TAC circuit 10*a* is stopped through the delay circuit 10*b*. Additionally, the flip-flop 35 enables the forward-backward counter 17. The forward-backward counter 17 is conditioned for forward counting when the sequence control circuit 20 is reset. Thus, it is assured that without any interruption the measuring of $t_{AM}$ is followed by the measuring of $n_M \cdot T_Q$ as defined above.

Meanwhile, the leading edge of the start signal has triggered the monostable multi-vibrator 30, the output of which is connected to one input of a further OR-gate 31 which resets the sequence control circuit 20. The sequence control 20 is "set" when the entire circuit arrangement is switched on. A further OR-gate 34 is also connected to the output of the monostable vibrator 30 for resetting the circuit arrangement 21 which produces a quartz precision start-stop-time difference for the internal calibration operation. The trailing edge of the pulse produced by the monostable multi-vibrator 30 switches the sequence control 20 to provide the time slot $Q_1$. Such switching takes place through the inverter circuit 32 and the clock AND-gate 33. Thus, the sequence control pulse on the conductor 61 enables through the OR-gate 10*g*, the AND-gate 10*f* whereby the latter passes the pulse coming from the monostable multi-vibrator 10*c* to the analog memory, for example, in the form of a sample and hold circuit 10*d*, whereby the time proportional analog voltage value from the TAC circuit 10*a* is stored in the sample and hold memory 10*d*. It will be recalled that the pulse, which switches the sample and hold memory circuit 10*d* to "storing" was produced through the leading edge $A_o$ of the time base signal which set the flip-flop 35. The time proportional analog voltage value $U_M$ is expressed as follows:

$$U_v - a \cdot t_{AM}$$

wherein $U_v$ is the supply operating voltage of the TAC circuit 10*a* and "a" is an analog conversion factor of the TAC circuit 10*a*. Thus, the measuring and storing of the time difference $t_{AM}$ is completed.

Upon arrival of the stop signal externally applied to the stop input 63 of the stop channel the following operation takes place in the stop channel which also comprises a time frame input 64. The stop channel comprises the so-called stop Null-OR-gate 19, the output of which is connected to a time delay circuit 42 which in turn is connected with its output to one input of a stop AND-gate 41 the other input of which is connected to the output of a further stop AND-gate 40 which in turn is connected with one of its inputs to the stop enable flip-flop 39 and with its other input to the above mentioned time frame input terminal 64. The output of the first mentioned stop AND-gate 41 is connected to the clock or set input of a stop flip-flop circuit 38 the output of which is connected to one input of a "start" OR-gate 23 in the stop channel. The output of the stop flip-flop 38 is further connected to the data input of a counter disable synchronizing flip-flop circuit 36 which in turn is connected with its output to one input of a stop OR-gate 25. The output of the stop OR-gate 25 is connected to a delay circuit 11*b* which in turn is connected with its output to the stop input of the TAC circuit 11*a* and to the clock or set input of a sample and hold monostable circuit 11*c*. The start input of the TAC circuit 11*a* is connected to the output of the "start" OR-gate 23. The output of the TAC circuit 11*a* is connected to two sample and hold circuits 11*d* and 11*e* which in turn are connected with their outputs to the negative and positive input terminals of a differential amplifier 13. The ouput of the differential amplifier 13 is connected to the analog input of an analog-to-digital converter 15. Thus, it will be seen that the structures of the start channel and of the stop channel are substantially identical. The leading edge of the stop signal sets the stop flip-flop 38 through the OR-gate 19, and the delay circuit 42 through the AND-gate 41, provided that the AND-gate also receives the appropriate time frame signal simultaneously through the AND-gate 40 from the input terminal 64. As mentioned with reference to the start flip-flop 37, the stop flip-flop 39 also makes it possible to process square wave stop signals having substantially any desired pulse width. The setting of the stop flip-flop 38 starts through the OR-gate 23 the TAC circuit 11*a* and thus the measuring of the time difference $T_{EM}$. The leading edge $A_n$ of the time base pulse next following the stop signal sets the counter disable synchronizing flip-flop 36 whereby the output Q of this flip-flop 36 stops the TAC circuit 11*a* through the stop OR-gate 25 and through the delay circuit 11*b*. The same signal triggers the monostable multivibrator 11*c*. Thus, the leading edge $A_n$ not only stops the measurement of the time difference $T_{EM}$, but it also disables the forward-backward counter 17 through the flip-flop 36, whereby the counting of the leading edges for ascertaining the time difference $n_M \cdot T_Q$ is completed.

The output Q of the sample and hold monostable circuit 11*c* provides an impulse to the control input of the analog memory or sample and hold circuit 11*d* through the control gates 11*f* and 11*g* which are also enabled by the signal on control conductor 61 which represents the time slot $Q_1$ as determined by the sequence control circuit 20. As a result, and in the same manner as was described above with reference to measuring the time difference $T_{AM}$ in the starting channel, the time proportional analogous voltage value $U_M$ for the stop is stored. $U_M$ is expressed as follows:

$$U_M = U_v - e \cdot t_{EM},$$

wherein $U_v$ is the supply voltage for the TAC circuit 11*a* and "e" is its analog conversion factor.

Further, the impulse provided at the output Q of the sample and hold monostable circuit 11*c* resets the flip-flops 37, 38 and 39 through the inverter 46. As a result, the start channel and the stop channel are again made ready for receiving new start and stop signals through the Null-OR-gates 18 and 19.

The trailing edge of the inverted impulse at the output of the inverter 46 now triggers or clocks through the clock AND-gate 33 the sequence control circuit 20 so that the latter provides the time slot $Q_2$ provided that the note flip-flop 29 is not set. Thus, the first time slot $Q_1$ for measuring the first three time components of the real time measurement provided in the above text with the index M and the storing of the time proportional analog voltage values in the analog sample and hold memories 10*d* and 11*d* are completed and the second time slot $Q_2$ begins. However, if the note flip-flop 29 is set through a signal applied to the comparing input 62 of the measuring circuit arrangement, the sequence control circuit 20 remains reset even after the resetting of the flip-flop 29. Thus, the measuring circuit keeps waiting for the next externally supplied start and stop signals. Thus, start signals not meeting certain requirements will not cause a measuring cycle. For example, if the square wave start signal and/or stop signal resulted from the wave shaping of the analog output signal of an overloaded amplifier or if these start and/or stop signals were derived from a substantially distorted analog signal, a comparator, the output of which is connected to the terminal 62, may provide the signal which keeps the note flip-flop 29 set. The comparator may, for example, monitor the voltage level.

As the time slot $Q_2$ begins, a zero deviation between the start channel and the stop channel is determined by running a three part measuring cycle through the circuit arrangement which cycle is basically the same as the three part measuring cycle. The values related to the zero deviation measuring cycle are provided with the index N. The zero deviation measurement is a real time measurement just as during the time slot $Q_1$. The leading edge of the time slot $Q_2$ passes through the delay circuit 43 and through the Null-OR-gates 18 and 19 to thereby produce simultaneously a start signal and a stop signal. As a result, the same operations take place as described above with reference to the time slot $Q_1$, however with one difference, namely, that the time proportional analog voltages $U_v - a \cdot t_{AN}$ or $U_v - e \cdot t_{EN}$ representing the time differences $t_{AN}$ or $t_{EN}$ as converted by the TAC circuits 10*a* and 11*a*, are now stored in the analog sample and hold circuits 10*e* and 11*e* rather than in 10*d* and in 11*d*. The forward-backward counter 17 is now switched for backward counting by the sequence control circuit 20 through the time slot $Q_2$. Upon completion of the zero deviation determining cycle the monostable multi-vibrator 11*c* produces an impulse which again resets the flip-flops 37, 38, and 29 and which shifts the sequence control circuit 20 to the time slot $Q_3$ whereby the measuring cycle is completed and the analog sample and hold memories 10*d*, 10*e*, 11*d*, and 11*e* now hold the time proportional analog voltage values $U_v - a \cdot t_{AM}$ and $U_v - a \cdot t_{AN}$ as well as $U_v - e \cdot t_{EM}$ and $U_v - e \cdot t_{EN}$.

The analog output of the sample and hold circuits 11*e* in the stop channel is connected to the positive input of the differential amplifier 13 while the ouput of the sample and hold memory 11*d* is connected to the negative input of said differential amplifier 13. Therefore, the output of the differential amplifier 13 in the stop channel supplies a voltage difference expressed as follows:

$$(U_{EM} - U_{EN}) = (U_v - e \cdot t_{EN}) - (U_v - e \cdot t_{EM}) = e \cdot (t_{EM} - t_{EN}) = e \cdot \Delta t_E .$$

This voltage difference represents the time difference $\Delta t_E$ multiplied by the conversion factor "e" of the TAC circuit 11*a* in the stop channel.

The analog outputs of the sample and hold memories 10*e* and 10*d* in the start channel are, as just described with reference to the stop channel, connected to the positive and negative input of the differential amplifier 12 which thus produces at its output the voltage difference:

$$(U_{AM} - U_{AN}) = (U_v - a \cdot t_{AN}) - (U_v - a \cdot t_{AM}) = (a \cdot (t_{AM} - t_{AN}) = a \cdot t_A$$

which provides the time difference $\Delta t_A$ multiplied by the analog conversion factor "a" of the TAC circuit 10*a* in the start channel. Additionally, the count in the forward-backward counter 17 corresponds to $n_M - n_N$ at the end of the time slot $Q_2$. This count multiplied by $T_Q$ represents the corresponding time difference $(n_M - n_N) \cdot T_Q$, wherein $n_M$ corresponds to a real time measurement and $n_N$ corresponds to a correction time measurement .

In the instance where small start-stop time differences are to be measured or in the instance where the zero deviation between the start channel and the stop channel is to be ascertained it may happen quite frequently that the leading edge $A_o$ only occurs after the leading edge of the stop signal which has meanwhile arrived. In such a situation the forward-backward counter 17 does not receive any pulses to be counted at all during the time slots $Q_1$ and $Q_2$ so that no real time measurements with the indeces M and N are being made. Stated differently, the count of the forward-backward counter 17 remains zero in such a situation which may be expressed as $n_M = 0$; $n_N = 0$.

As the sequence control circuit 20 is clocked or triggered to provide the time slot $Q_3$ the time proportional, analog voltage differences:

$$(U_{AM} - U_{AN}) = (U_v - a \cdot t_{AN}) - (U_v - a \cdot t_{AM}) = a \cdot (t_{AM} - t_{AN}) = a \cdot \Delta t_A)$$

and $$(U_{EM} - U_{EN}) = (U_v - e \cdot t_{EN}) - (U_v - e \cdot t_{EM}) = e \cdot (t_{EM} - t_{EN}) = e \cdot \Delta t_E$$

are digitized and the resulting digital values are further processed together with the count in the counter 17 by means of a computer such as a micro-processor 26 which handles said digital values and the count $n_M - n_N$ provided by the counter 17. During the time slot $Q_3$ the following operations take place. The signal defining the time slot $Q_3$ passes through the OR-gate 48 to the start conversion inputs of the analog-to-digital converters 14 and 15. The analog inputs of these converters are connected to the analog outputs of the differential amplifiers 12 and 13. Thus, the conversion of the above mentioned analog voltage differences into the respective digital values $\Delta t_{AD}$ and $\Delta t_{ED}$ takes place. Simultaneously, the $Q_3$ signal causes a program interruption in the micro-processor 26 through the interruption request input 27 of the micro-processor 26. The micro-processor 26 addresses the data output buffer of the forward-backward counter 17 through the read AND-gate 54 connected to said data output buffer of the counter 17 thereby reading the count of the counter, namely, $n_M - n_N$ as represented by the counter output data $Z_1$ to $Z_n$. In the meantime, the analog-to-digital conversion has been completed and the analog-to-digital converter outputs are marked that the conversion is completed, whereby these output caused the micro-processor 26 through the AND-gates 51 and 49 and through the interruption request input 27 to read the digital values $\Delta t_{AD}$ and $\Delta t_{ED}$ which are stored in the data output buffers of the analog to digital converters 14 and 15. The data $A_1$ to $A_n$ are provided at the output of the converter 14. The data $E_1$ to $E_n$ are provided at the outputs of the converter 15. For this purpose the data output buffers are addressed by the micro-processor 26 through the read AND-gate 55 and the read AND-gate 53 connected to the output buffer enable input of the respective A/D converter.

It will depend on the program stored in the micro-processor 26 whether the digital values $\Delta t_{AD}$, $\Delta t_{ED}$, and $n_M - n_N$ stored in the memory of the micro-computer 26 are instantaneously further processed, for example, for display in the display unit 28, or whether this processing takes place later during the time slot $Q_7$. In any event, the program in the micro-computer 26 will be established in accordance with the particular objective. If the data processing takes place during the time slot $Q_7$ the then produced scaling or rather calibration factors $S_A$, $S_E$ may be employed which are ascertained in the time slot $Q_7$ for the then current measuring and calibration cycle. In any event, the display unit 28 displays the corrected and scaled, or rather calibrated digital time measured value $\Delta t$.

If it is necessary to provide a corrected digital measured value $\Delta t_{cor\ D}$ representing the start-stop-time difference as a calibrated value, as rapidly as possible after the arrival of an externally supplied start and stop signal, it is necessary to use the digital scaling or rather calibration factors $S_A$ and $S_E$ which were ascertained in the preceding measuring and calibration cycle in order to provide the multiplication values $S_A \cdot \Delta t_{AD} + (n_M - n_N)T_Q - S_E \cdot \Delta t_{ED}$. If the digital measured value $\Delta t_{cor\ D}$ has been entered by the micro-processor 26 through the loading AND-gate 58 into the data input buffers $D_1$ to $D_p$ of the display unit 28, the micro-processor 26 will then trigger or clock the sequence control circuit 20 so that the latter provides the time slot $Q_4$, whereby the calibration cycle begins. This triggering or clocking of the sequence control circuit 20 by the micro-processor 26 takes place through the clock AND-gate 56, the clock OR-gate 44 and the monostable multi-vibrator 45.

The time slot signal $Q_4$ resets the forward-backward counter 17 for the next measuring cycle, this signal $Q_4$ also switches the gates **10*h* and 10*j* as well as 11*h* and 11*j* for the control of the sample and hold analog memories 10*e* and 11*e*, into the ready state. The signal $Q_4$ simultaneously causes a calibration start signal and a calibration stop signal through the first calibration input of the circuit arrangement 21 which produces quartz precision start-stop-time differences. These calibration start and stop signals are supplied to the start OR-gate 22 and the stop OR-gate 24 in the start channel and to the start OR-gate 23 and the stop OR-gate 25 in the stop channel. The time proportional analog voltage value $U_v - a \cdot t_{cal\ N}$ at the output of the TAC circuits 10*a* and the time proportional analog voltage value $U_v - a \cdot t_{cal\ M}$ at the output of the TAC circuit 10*a* as well as the time proportional analog voltage value $U_v - e \cdot t_{cal\ M}$ at the output of the TAC circuit 11*a* represent the zero deviation between the input of the start OR-gate 22 and the input of the stop OR-gate 24 in the start channel as well as the zero deviation between the input of the start OR-gate 23 and the input of the stop OR-gate 25 in the stop channel as has been described above with reference to the measuring cycle. These values are stored in the analog sample and hold memories 10*e* or 11*e* respectively. The trailing edge of the pulse produced by the monostable multivibrator 11*c* clocks the sequence control circuit 20 through the clocking AND-gate 33 to provide the time slot $Q_5$. With the beginning of the time slot $Q_5$ the circuit arrangement 21 is reset through the OR-gate 34. After such resetting the time slot $Q_6$ is now provided by further clocking the sequence control circuit 20 through the clocking OR-gate 44, through the monostable multi-vibrator 45 and through the clocking AND-gate 33. The time slot signal $Q_6$ initiates the second portion of the calibration sequence through the second calibration input of the circuit arrangement 21. Simultaneously the time slot signal $Q_6$ enables the control gates 10*f* and 10*g* as well as 11*g* and 11*f* for the sample and hold sample memories 10*d* and 11*d*. Thereupon the circuit arrangement 21 supplies, correlated with the time base signal, a calibration start signal and a calibration stop signal to the start and stop OR-gate inputs as described above for the first calibration step during the time slot $Q_4$, whereby in this instance the leading edge of the calibration stop signal and the leading edge of the calibration start signal are spaced relative to each other with quartz precision by one period duration $T_Q$ of the time base signal produced by the quartz generator 16**.

After measuring this quartz precision time difference by means of the TAC circuits **10*a* and 11*a*** the measured results are stored as analong voltage values:

$$U_v - a \cdot t_{cal\ M}$$

$$U_v - e \cdot t_{cal\ M}$$

whereby with the aid of the differential amplifiers 12 and 13 the time proportional voltage differences are obtained:

$$U_{cal\ AM} - U_{cal\ AN} = a \cdot \Delta t_{cal\ A}$$

or $$U_{cal\ EM} - U_{cal\ EN} = e \cdot \Delta t_{cal\ E} \cdot$$

These voltage values constitute the actual measured value diminished by the respective zero deviation and correlated to the respective time voltage conversion factor "a" or "e", said zero deviation occurring between the start and stop input of the start OR-gates 22, 23, and the stop OR-gates 24, 25. The trailing edge of the impulse produced by the sample and hold monostable circuit **11*c* terminates the time slot $Q_6$ and clocks the sequence control circuit 20** to provide the time slot $Q_7$ with the respective timing signal During the time slot $Q_7$ the actual values are digitized, the actual value is compared with the respective rated value and the digital scaling, or rather calibration factors $S_A$ and $S_E$ are obtained from said comparing. For this purpose the time proportional voltage differences:

$$U_{cal\ AM} - U_{cal\ AN} \text{ or } U_{cal\ EM} - U_{cal\ EN}$$

as described above in connection with the time slot $Q_3$, are converted into the respective digital time difference values:

$$t_{cor\ D} = (S_A \cdot \Delta t_{AD}) - (N_M - n_N) \cdot S_Q - S_E \Delta t_{ED}$$

by means of the analog-to-digital converters 14 or 15 which have been started through the OR-gate 48. After completion of the conversion the digital time difference values:

$$t_{cor\ D}=(S_A\cdot\Delta t_{AD})-(n_M-n_N)\cdot S_Q-S_E\Delta t_{ED}$$

are transferred into the micro-processor 26 for further processing. The transfer is accomplished through the AND-gates 50 and 52 and through the interruption request input 27 of the micro-processor 26.

During the following comparing of the rated value with the actual value the just mentioned digital actual values $\Delta t_{cal\ AD}$ and $\Delta t_{cal\ ED}$ are compared with the digital rated value $S_Q$ corresponding to the period $T_Q$ of the time base signal. The digital rated value $S_Q$ is stored in the micro-processor 26. The quotients constitute the new digital scaling or calibration factors $S_A$, or $S_E$. The time proportional digital value $\Delta t_{AD}$ or $\Delta t_{ED}$ obtained in the measuring cycle during the time slots $Q_1$ and $Q_2$ must be multiplied with the scaling or calibration factor $S_A$, $S_E$ respectively in order to form the exact digital time measured $\Delta t_{cor\ D}$ namely the expression:

$$(S_A\cdot\Delta t_{AD}+(n_M-n_N)\cdot S_Q-S_E\cdot\Delta t_{ED})$$

The so formed expression may then be displayed. At the end of the time slot $Q_7$ the micro-processor 26 clocks the sequence control 20 to provide the time slot $Q_8$. Said clocking is accomplished through the clocking AND-gate 57, the OR-gate 44, the monostable circuit 45 and the AND-gate 33. The time slot signal $Q_8$ resets the sequence control 20 through the OR-gate 31, whereby the measuring of the time difference between the leading edge of an externally supplied start signal and the leading edge of an externally supplied stop signal may take place.

It will depend substantially on the temperature and flow characteristics of the environment in which the measuring takes place whether the scaling or correction factors $S_A$ and $S_E$ are to be determined after each measuring cycle. In any event, the use of a micro-processor 26 makes it possible to adapt the measuring operation in an optimal manner to the measuring precision and/or the measuring speed.

With regard to the delay circuits **10*b* and 11*b* it should be noted that it is their purpose to operate the respective TAC circuit 10*a* and 11*a*** in the linear range of its operational characteristic to avoid distortion errors.

The circuit arrangement according to the invention illustrated in FIGS. 1, 2, 3, and 4, has been dimensioned to ascertain as rapidly as possible a precise digital measured value for the time difference between the leading edges of externally applied start and stop signals. Thus, the digital value $\Delta t_{cor\ D}$ is ascertained as quickly as possible. However, if between the arrival of two pairs of start-stop signals there is sufficient time for the processing of the measured signal, it is possible to reduce the number of circuit components while maintaining the measuring principle according to the invention. Thus, the number of analog memories, the number of differential amplifiers, and the number of analog-to-digital converters could be reduced with a respective reduction in the current consumption and in the costs for the circuit components while simultaneously increasing the compactness of the time measuring apparatus according to the invention. Depending on the available time for the processing of the measured signal, two modifications of the circuit arrangement of the invention are possible. The first modification comprises instead of the four analog memories **10*d*, 10*e*, 11*d*, 11*e* only two analog memories 10*d* and 11*d*. The differential amplifiers 12 and 13 as well as the control gates 10*f* to 10*j* and 11*f* and 11*j* may also be omitted. Additionally, the Q-output of the monostable multi-vibrator 11*c* will not be connected through the inverter 46 with the clocking AND-gate 33, rather, it will be connected to the start inputs of the analog-to-digital converters 14 and 15. Thus, each time after the storing of the time proportional, analog voltage value during the measuring cycle and during the calibration cycle, the respective digital value is ascertained and transferred into the micro-computer 26. The formation of the time proportional analog voltage differences $U_{AM}-U_{AN}$ and $U_{EM}-U_{EN}$ by means of the differential amplifiers 12 and 13 now takes place with the aid of the microcomputer or processor 26. However, the program in the computer 26 as well as the circuit connections between the interruption request inputs and the respective AND-gates 49, 50, 51, 52 will have to be modified. The sequence control circuit 20 will always be clocked in this modified version by the computer 26 through the gates 56 or 57**.

The second modification still comprises the two analog memories **10*d* and 11*d*, however, omits one of the two analog-to-digital converters 14 or 15. This type of arrangement further reduces the current consumption and the costs for the circuit components. However, two analog switches are added in this second modification said switches including the respective addressing control logic for the alternate connection of the two analog outputs of the memories 10*d* or 11*d* to the analog inputs of the single analog-to-digital converter. The program and interrupt structure of the micro-processor 26** would be correspondingly adapted.

In the light of the above detailed disclosure it will be appreciated that the version described with reference to FIGS. 1 to 4 provides the most rapid ascertaining of the digital measured value $\Delta t_{cor\ D}$ following the arrival of the two start and stop signals forming a pair. Thus, the number of start-stop signal pairs per unit of time is largest in this modification. Accordingly, the number of required circuit components and the respective costs as well as the space and power supply requirements are largest in this embodiment. The second embodiment, or rather the first modification, reduces costs, space, and power supply requirements, however, it reduces the number of pairs of start-stop signals that may be processed per unit of time. The second modification is most advantageous as far as costs, space requirements, and power supply requirements are concerned. However, the number of pulse pairs that may be processed in the second modification is smallest compared to the other two embodiments.

Incidentally, instead of using a micro-processor 26 as described, it is possible to operate in accordance with the present teaching by using a conventional computer of any size by respectively adapting the computer addressing, as disclosed herein.

In view of the above it will be appreciated that according to the invention the measurement of the real time components ($t_A$), ($n\cdot T_Q$), and ($t_E$) are performed automatically in sequence during a complete measuring cycle. The actual time difference $\Delta t_M=t_{AM}+n_M\cdot T_Q-t_{EM}$ between the leading edge of the starting signal and the leading edge of the stop signal is ascertained and the respective analog voltages $t_{AM}$ and $t_{EM}$ are stored in the respective sample and hold circuits. First the counter 17 is counting forward and then the counter 17 is counting backward when the measurement takes place in response to a pair of internally produced precisely spaced start and stop signals in the circuit arrangement 21 under the control of the quartz generator 16. Thus, the so-called Null-time difference between the start channel and the stop channel is ascertained $\Delta t_N = t_{AN} + n_N \cdot T_Q - t_{EN}$. The real time difference $\Delta t$ which is not yet scaled is then ascertained by forming the difference between the two time differences $\Delta t_M$ and $\Delta t_N$, whereby the index M designates the measurements in response to the externally supplied pair of start and stop pulses while the index N designates the measurement in response to the internally produced start-stop pulses. The difference is formed as follows:

$$\Delta t_M - \Delta t_N = (t_{AM} + n_M \cdot T_Q - t_{EM}) - (t_{AN} + n_N \cdot T_Q - t_{EM}) = (t_{AM} - t_{AN}) + (n_M - n_N) \cdot T_Q - (t_{EM} - t_{EN}).$$

The time difference $\Delta t_A = (t_{AM} - t_{AN})$ passes through the differential amplifier 12 in the starting channel. The difference $\Delta t_E = (t_{EM} - t_{EN})$ passes through the differential amplifier 13 in the stop channel. The difference $(n_M - n_N)$ is indicated by the count in the counter 17. The differential amplifiers 12 and 13 produce respective analog voltages $(U_{AM} - U_{AN})$ or $(U_{EM} - U_{EN})$ corresponding to the time differences $\Delta t_A$ and $\Delta t_E$. These analog voltages are supplied to the anaolg-to-digital converters to form respective bipolar digital values $\Delta t_{AD}$ and $\Delta t_{ED}$. The final real time is then computed by the micro-processor 26. The digital value $\Delta t_{AD}$ is multiplied by the scale factor $S_A$. The digital value $n_M - n_N$ is represented by the bits $Z_1$ to $Z_n$ in the output buffer of the counter 17 and is multiplied by the scale factor $S_Q$. Incidentally, the digital value $\Delta t_{AD}$ is represented by the digital output bits $A_1$ to $A_n$ in the output buffer of the A/D converter 14. The digital value $\Delta t_{ED}$ is represented by the digital output bits $E_1$ to $E_n$ in the ouput buffer of the A/D converter 15. The digital value $\Delta t_{ED}$ is multiplied by the scaling factor $S_E$. Thus, the following operation is performed in the micro-processor 26

$$\Delta t_D = \Delta t_{AD} \cdot S_A + (n_M - n_N) \cdot S_Q - \Delta t_{ED} \cdot S_E$$

This result is then converted in the micro-processor 26 into a bit pattern $D_1$ to $D_p$ suitable for display and such bit pattern is then loaded into the input buffer of the display unit 28.

According to the invention the scaling factor $S_A$ of the TAC circuit 10a and the scaling factor $S_E$ of the TAC circuit 11a are checked either after each measuring cycle or randomly after a random number of measuring cycles. This checking is accomplished in a separate calibration cycle comprising two real time measurements to produce updated calibration factors. For this purpose the circuit arrangement 21 provides precise start-stop time differences controlled by the time base signal generated by the quartz generator 16. The calibration start signal for the first calibration time measurement is supplied to the two start OR-gates in the start channel and in the stop channel. The respective, time-wise precisely spaced calibration stop signal is supplied to the two stop OR-gates in the start channel and in the stop channel. The same takes place during the second calibration time measurement and in addition the digital values $\Delta t_{cal,AD}$ and $\Delta t_{cal,ED}$ are produced in the analog-to-digital converters 14 and 15. In the further update processing of the calibration values these digital values are called up by the micro-processor 26 for comparing with the digital rated value $S_Q$ which is linked to the quartz oscillator frequency by the period duration $T_Q$ of the frequency of the quartz oscillator 16. Such comparing takes place by dividing the rated frequency value by the digital calibration values as follows:

$$S_A = S_Q / t_{cal,AD}$$

and $$S_E = S_Q / t_{cal,ED}$$

The formation of these digital values is repeated, as mentioned, after each measuring cycle or randomly after several measuring cycles.

According to the invention the externally applied start signal starts the sequence control circuit 20 which then provides the eight time slots $Q_1$ to $Q_8$ mentioned above. These eight time slots define a complete measuring cycle and a complete calibration cycle.

The first time slot $Q_1$ is for ascertaining the uncorrected time measurement $$\Delta t_M = t_{AM} + n_M \cdot T_Q - t_{EM}$$

The second time slot $Q_2$ is for the correction of the time measurement made during $Q_1$. During the second time slot $Q_2$ the null deviation $$\Delta t_N = t_{AN} + t_{nN} \cdot T_Q - t_{EN}$$

between the start channel and the stop channel is ascertained and the corrected time difference $\Delta t_{cor}$ is formed as follows:

$$\Delta t_{cor} = \Delta T_M - \Delta T_N = (t_{AM} - t_{AN}) + (n_M - n_N) T_Q - (t_{EM} - t_{EN}) = \Delta t_A + (n_M - n_N) T_Q - \Delta t_E,$$

whereby the time differences $$\Delta t_A = (t_{AM} - t_{AN})$$

and $$\Delta t_E = (t_{EM} - t_{EN})$$

are formed as time proportional, analog voltage differences $U_{AM} - U_{AN}$ and $U_{EM} - U_{EN}$. For this purpose each of the TAC circuits 10a and 11a, each of the sample and hold circuits 10d and 11d, and each of the differential amplifiers 12 and 13 are used twice. The difference $n_M - n_N$ is ascertained as the count in the forward-backward counter 17.

The third time slot $Q_3$ is for digitizing, scaling, storing, or displaying the thus corrected mixed analog-digital time difference $\Delta t_{cor}$. The time proportional analog voltage differences $(U_{AM} - U_{AN})$ and $(U_{EM} - U_{EN})$ provide the respective time differences $\Delta t_A$ and $\Delta t_E$. The voltage differences are converted in the analog-to-digital converters 14 and 15 to provide the respective digital time differences $\Delta t_{AN}$ and $\Delta t_{ED}$ which are further processed in the micro-computer or micro-processor 26. The digital values $\Delta t_{AD}$ and $\Delta t_{ED}$ and $n_M - n_N$ are sequentially multiplied by the scaling or calibration factors $S_A$; $S_E$; and $S_Q$ and then the sum is formed with the proper sign, thus:

$$\Delta t_{cor} = \Delta t_{AD} \cdot S_A + (n_M - n_N) \cdot S_Q - \Delta t_{ED} \cdot S_E$$

This value $\Delta t_{cor}$ is then either stored in a memory or displayed. The fourth time slot $Q_4$ provides time for initiating the calibration of the time amplitude conversion circuits (TAC circuits 10a, 11a) in the start channel and in the stop channel. This calibration is done by producing, preferably internally, precisely spaced start and stop signals under the precision control of the quartz generator 16. The quartz controlled calibration start signal is supplied to the start OR-gates 22 and 23. The quartz controlled calibration stop signal is supplied to the stop OR-gates 24 and 25 whereby the period $T_Q$ of the frequency of the quartz oscillator 16 determines the precise time spacing between these calibration start and stop signals when the respective time difference $T_Q$ is measured by means of said TAC circuits and by storing the analog voltage values $U_{cal\,AM}$ and $U_{cal\,EM}$ in the respective sample and hold circuits 10e and 11e whereby the first calibration step cal-1 is performed.

The fifth time slot $Q_5$ provides time for any resetting required following the first calibration step cal-1 and for preparing the second calibration step cal-2.

The sixth time slot $Q_6$ provides time for performing the second calibration step cal-2 to determine the null deviation between the respective inputs of the start OR-gates 22, 23 and stop OR-gates 24, 25 of the TAC circuits 10a and 11a as well as of the delay circuits 10b, 11b. Here again start and stop signals are produced but now these signals are applied simultaneously to the inputs of the start OR-gates 22, 23 and to the inputs of the stop OR-gates 24, 25. The resulting analog voltages $U_{cal\,AN}$ and $U_{cal\,EN}$ are stored in the respective sample and hold circuits. The respective, corrected time proportional analog voltage differences $$U_{cal\,AM} - U_{cal\,AN}$$

and $$U_{cal\,EM} - U_{cal\,EN}$$

are formed by the differential amplifiers 12 and 13.

The time slot $Q_7$ provides time for ascertaining the multiplication or correction factors $S_A$ and $S_E$ which are also referred to as scaling or calibration factors for the TAC circuits. These factors may be used for correction during the time slot $Q_3$ of the next time sequence. During $Q_7$ the analog-to-digital converters 14, 15 convert the time proportional, analog voltage differences set forth above into respective digital values $t_{cal\,AD}$ and $t_{cal\,ED}$. These values are the measured values which are now compared in the micro-computer 26 with the rated digital value $S_Q$ corresponding to the period duration $T_Q$ of the quartz oscillator 16. The new scaling or calibration factors $S_A$ and $S_E$ are then formed as follows:

$$S_A = S_Q / t_{cal\,AD}$$

and $$S_E = S_Q / t_{cal\,ED}$$

During the time slot $Q_8$ the sequence control circuit 20 is reset.

According to the invention there are further provided means for monitoring the quality of the externally produced signals, especially the stop signal which may have been derived by generating respective waveforms, for example a square wave. The comparing input and a time frame input serve for this purpose. Thus, a square wave stop signal derived from an analog signal coming from an overloaded amplifier may be prevented from becoming effective by means of a comparator. The stop signal having too high an amplitude, for example, switches a comparator which is connected with its output to the compare input 62 of the time measuring circuit. The input 62 sets the note flip-flop 29 whereby the sequence control circuit arrangement 20 already started by the start signal, is reset again. Moreover, any stop signal that has been derived from an analog signal containing heavy noise components and/or from a distorted analog signal by wave formation may become effective in stopping a time difference measurement between the leading edge of the start signal and the leading edge of the stop signal, only if the expected stop signal arrives within a time limit determined by the signal applied to the time frame input 64.

According to a further modification of the invention the data processing of the micro-processor 26 may be modified so that during a complete measuring and calibration cycle, the time slot $Q_3$ is used only for digitizing the time proportional, analog voltage differences $$U_{AM} - U_{AN} \text{ and } U_{EM} - U_{EN}$$

and the respective digital values $$\Delta t_{AD} \text{ and } \Delta t_{ED}$$

as well as the count $n_M - n_N$ in the forward-backward counter 17 are transferred into the micro-processor 26. The time slot $Q_7$ is then used to ascertain the scaling or calibration factors $S_A$ and $S_E$ and to calculate the corrected and scaled measured time value $$\Delta t_{cor\,D} = \Delta t_{AD} \cdot S_A + (n_M - n_N) \cdot S_Q - \Delta t_{ED} \cdot S_E$$

with the aid of said factors just obtained. The result $\Delta t_{cor\,D}$ is then stored or displayed as described.

Although the invention has been described with reference to specific example embodiments, it is to be understood that it is intended to cover all modifications and equivalents within the scope of the appended claims.

What is claimed is:

1. A method for measuring the time between a first occurring start impulse signal and a subsequently occurring stop impulse signal, comprising the following steps:

(a) generating in a signal processing circuit arrangement a constant frequency time base signal having a fixed period ($T_Q$);

(b) supplying said start impulse signal to start channel means of said signal processing circuit arrangement for beginning a counting of time base signal periods after a measurable first length of real time ($t_A$) following the occurrence of said start impulse signal;

(c) supplying said stop impulse signal to stop channel means of said signal processing circuit arrangement for stopping the counting after a measurable second length of real time ($t_E$) following the occurrence of the stop impulse signal, whereby the counting of the time base signal periods constitutes a measuring of a third length of real time ($n \cdot T_Q$) wherein n is the number of counted leading edges of said time base signal having said period ($T_Q$);

(d) measuring said first measurable length of real time ($t_A$) and adding it to said third length of real time, and (e) measuring said second measurable length of real time ($t_E$) and deducting it from said third length of real time to produce a first time measurement result ($\Delta t$) whereby the time length of any time duration may be measured with a high resolution.

2. The method of claim 1, wherein said first measurable real time ($t_A$) and said second measurable real time ($t_E$) are determined by respective time amplitude converter circuits in said start channel circuit means and in said stop channel circuit means.

3. The method of claim 2, wherein said time base signal is generated as a square wave signal, wherein said counting of time base signal periods begins with the first positive going leading edge of said time base square wave signal following said start impulse signal, and wherein said counting of time base signal periods is stopped by the first positive going leading edge of said time base square wave signal following said stop impulse signal.

4. The method of claim 3, wherein said measuring of said first real time ($t_A$) begins with the positive going leading edge of the start impulse signal and ends with that positive going leading edge of the time base signal which starts the counting of time base signal periods, and wherein said measuring of said second real time ($t_E$) begins with the positive going leading edge of the stop pulse signal and ends with that positive going leading edge of the time base signal which terminates the last counted time base signal period.

5. The method of claim 1, further comprises automatically repeating said first, second, and third real time measuring steps during a measuring cycle by generating simultaneously an internal square wave start signal and an internal square wave stop signal to produce a second time measurement result ($\Delta t_N$); subtracting the second time measurement result from the first time measurement result to form a resulting difference signal corresponding to the length of time between leading edges of said start and stop impulse signals, and digitizing said resulting difference signal for subsequent utilization.

6. The method of claim 5, further comprising automatically performing, after a measuring cycle, a calibration cycle which also comprises two real time measurements each including three real time components, said calibration measurements being based on respective start and stop signals which are derived from said constant frequency time base signal and hence have a defined time spacing one from the other.

7. The method of claim 6, wherein said calibration cycle is performed after each measuring cycle for repeatedly producing updated calibration factors.

8. The method of claim 6, wherein said calibration cycle is performed after a random number of measuring cycles for repeatedly producing updated calibration factors.

9. The method of claim 5, wherein said counting of time base signal periods for said third real time component during the first time measurement and during the second time measurement is performed by means of a forward-backward counter which counts in one direction during said first time measurement and in the opposite direction during the second time measurement, whereby said resulting difference is automatically established, wherein a leading edge ($A_o$) of the time base signal following a start impulse signal, enables the forward-backward counter, whereas a leading edge ($A_n$) of the time base signal following a stop impulse signal disables the forward-backward counter whereby the latter counts all leading edges of the time base signal following the start impulse signal so that the measured time corresponds to ($n \cdot T_Q$) wherein n is the number of leading edges counted and $T_Q$ is the period of the time base signal.

10. The method of claim 1, wherein said constant frequency time base signal is generated by means of a free-running quartz oscillator in the form of a square wave.

11. The method of claim 1, wherein each start impulse signal starts a sequence control means (20) for establishing eight time sections ($Q_1$ to $Q_8$) which define a complete measuring cycle and a complete calibration cycle, wherein a first time section ($Q_1$) is allocated for an uncorrected time measuring, wherein a second time section ($Q_2$) is allocated for the correction of the uncorrected time measured in section ($Q_1$), wherein a third time section ($Q_3$) is allocated for digitizing, wherein a fourth time section ($Q_4$) is allocated for a first calibration step; wherein a fifth time section ($Q_5$) is allocated for resetting after the first calibration step and for preparing of a second calibration step, wherein a sixth time section ($Q_6$) is allocated for a second calibration step; wherein a seventh time section ($Q_7$) is allocated for calculating updated calibration factors; and wherein an eighth time section ($Q_8$) is allocated for resetting the entire system for a new operational sequence.

12. The method of claim 11, wherein during said third time section ($Q_3$) also a scaling and utilization of the corrected time difference is performed.

13. The method of claim 11, further comprising producing time proportional analog voltages, producing differences from said time proportional analog voltages, digitizing said differences to produce respective digitized values and transferring the respective digitized values and a count from a forward-backward counter (17) to a computer (26) during said third time section ($Q_3$), and then correcting and scaling the digitized values during the seventh time section ($Q_7$) by using said updated calibration factors.

14. The method of claim 1, further comprising monitoring at least said stop impulse signal for preventing an impulse signal which does not meet certain criteria, from causing a stop operation.

15. The method of claim 14, wherein said monitoring comprises checking the shape of the stop impulse signal waveform and further checking whether the stop impulse signal occurs within a given time frame.

16. A circuit arrangement for measuring the time between a first occurring start impulse signal and a subsequently occurring stop impulse signal, comprising signal processing circuit means including constant frequency generator means (16) for generating a time base signal having a fixed period ($T_Q$), start signal processing channel circuit means including a start input for receiving a start impulse signal for beginning a counting of time base signal periods after a measurable first length of real time ($t_A$) following the occurrence of said start impulse signal, stop signal processing channel circuit means including a stop input for receiving a stop impulse signal for stopping the counting after a measurable second length of real time ($t_E$) following the occurrence of the stop impulse signal, counter means operatively connected to said start and stop signal processing channel circuit means for counting time base signal periods constituting a third length of real time, first time amplitude conversion circuit means (TAC 10*a*) operatively connected in said start signal processing channel circuit means for measuring said first length of real time ($t_A$), second time amplitude conversion circuit means (TAC 11*a*) operatively connected in said stop signal processing channel circuit means for measuring said second length of real time ($t_E$), and computing circuit means operatively connected to said start and stop signal processing channel circuit means and to said counter means for adding the first length of real time ($t_A$) to said third length of real time and for deducting said second length of real time ($t_E$) from said third length of real time to produce a first time measurement result ($\Delta t$), whereby the length of any time duration may be measured with a high resultation.

17. The circuit arrangement of claim 16, wherein said constant frequency generator means (16) comprises a free-running square wave oscillator operatively connected to said start channel and to said stop channel and wherein said constant frequency free-running square wave oscillator (16) is a quartz oscillator.

* * * * *